US007817129B2

(12) United States Patent
Jackson et al.

(10) Patent No.: US 7,817,129 B2
(45) Date of Patent: Oct. 19, 2010

(54) INTEGRATED LINE SELECTION APPARATUS WITHIN ACTIVE MATRIX ARRAYS

(75) Inventors: Warren Jackson, San Francisco, CA (US); Carl Taussig, Redwood City, CA (US); Hao Luo, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1024 days.

(21) Appl. No.: 11/590,339

(22) Filed: Oct. 30, 2006

(65) Prior Publication Data

US 2008/0100559 A1 May 1, 2008

(51) Int. Cl.
*G09G 3/36* (2006.01)

(52) U.S. Cl. ..... 345/100

(58) Field of Classification Search ..... 345/98–100; 327/407, 413; 365/230.06
See application file for complete search history.

(56) References Cited

U.S. PATENT DOCUMENTS

| | | | | |
|---|---|---|---|---|
| 6,535,455 | B1 | 3/2003 | Hogan et al. | |
| 7,573,452 | B2 * | 8/2009 | Nathan et al. | 345/92 |
| 2005/0055387 | A1 * | 3/2005 | Kuekes et al. | 708/1 |

OTHER PUBLICATIONS

N. Mohan et al., "Stability Issues in Digital Circuits in Amorphous Silicon Technology," Proceedings from IEEE CCECE, 2001, pp. 583-588, vol. 1, Toronto, Canada.

A. Kumar et al., "Amorphous Silicon Shift Registers for Display Drivers," Journal of Vacuum Science & Technology A: Vacuum, Surfaces and Films, May 2004, pp. 981-986, vol. 22, Issue 3, Electrical and Computer Engineering, University of Waterloo, Ontario N2L3G1, Canada.

* cited by examiner

*Primary Examiner*—Bipin Shalwala
*Assistant Examiner*—Steven E Holton

(57) ABSTRACT

An integrated line selection apparatus within active matrix arrays is described. The circuit includes multiple gate line drive transistor devices, each gate line drive transistor device having a drain coupled to a gate line of multiple gate lines in a gate line driver circuit coupled to an active matrix array and a source to receive an input signal. The circuit further includes at least one address line transistor device corresponding to each gate line transistor device, each address line transistor device having a drain coupled to a gate of the corresponding gate line drive transistor device and a gate coupled to a corresponding address line, such that by asserting a predetermined combination of voltages on the plurality of address lines, a single gate line of said plurality of gate lines is selected to receive the input signal to be transmitted to a corresponding pixel within the corresponding active matrix array.

13 Claims, 8 Drawing Sheets

INTEGRATED LINE SELECTION APPARATUS WITHIN ACTIVE MATRIX ARRAYS

BACKGROUND

1. Field of the Invention

The present invention relates generally to display technologies and, more specifically, to an integrated line selection apparatus within active matrix arrays.

2. Background

Flat panel displays with electrophoretic, liquid crystal (LC), or organic light emitting diode (OLED) based pixel technology, as well as many sensor applications, all rely on a well known low temperature active matrix backplane technology to address the individual pixels in the matrix array. In an active matrix array, each pixel is controlled by one to four transistors and selection of the active gate lines in the array is typically performed using crystalline silicon Complementary Metal Oxide Semiconductor (CMOS) multiplexers and line drivers.

However, the high voltage required to drive multiple backplane transistors within the active matrix array adds to the costs of the integrated circuit. In addition, the large number of interconnects required to address the pixels in the matrix array also increase the assembly costs of the flat panel displays.

Accordingly, there is a need for a method and apparatus for efficient integration of gate line selection into the low temperature active matrix display manufacturing process in order to reduce manufacturing costs and the number of components, thus improving the reliability of the product.

SUMMARY

An integrated line selection apparatus within active matrix arrays is described. The circuit includes multiple gate line drive transistor devices, each gate line drive transistor device having a drain coupled to a gate line of multiple gate lines in a gate line driver circuit coupled to an active matrix array and a source to receive an input signal. The circuit further includes at least one address line transistor device corresponding to each gate line transistor device, each address line transistor device having a drain coupled to a gate of the corresponding gate line drive transistor device and a gate coupled to a corresponding address line, such that by asserting a predetermined combination of voltages on the plurality of address lines, a single gate line of said plurality of gate lines is selected to receive the input signal to be transmitted to a corresponding pixel within the corresponding active matrix array.

DETAILED DESCRIPTION

Figure 1:
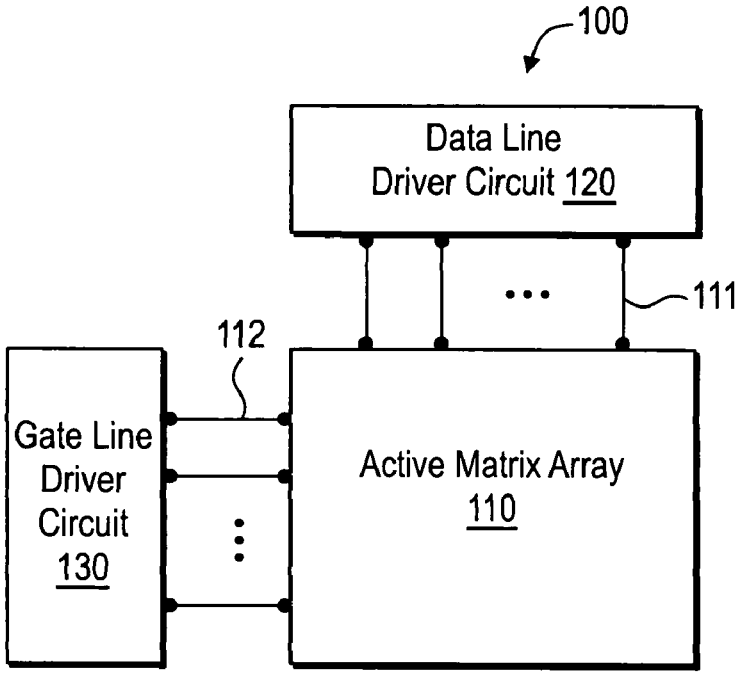
FIG. 1 (Prior Art)
FIG. 1 is a block diagram illustrating an exemplary prior art display system, which includes an active matrix array.

FIG. 1 is a block diagram illustrating an exemplary display system, which includes an active matrix array. As illustrated in FIG. 1, the system 100, such as, for example, a liquid crystal display device, includes an active matrix array 110 containing a plurality of pixels arranged in a two-dimensional matrix form. The active matrix array 110 receives video signals from a data line driver circuit 120 via multiple data lines 111. The active matrix array further receives timing signals at predetermined intervals from a gate line driver circuit 130 via multiple gate lines 112. The gate line driver circuit 130, such as, for example, a shift register circuit, is configured to assert each gate line 112 in sequence.

Figure 2:
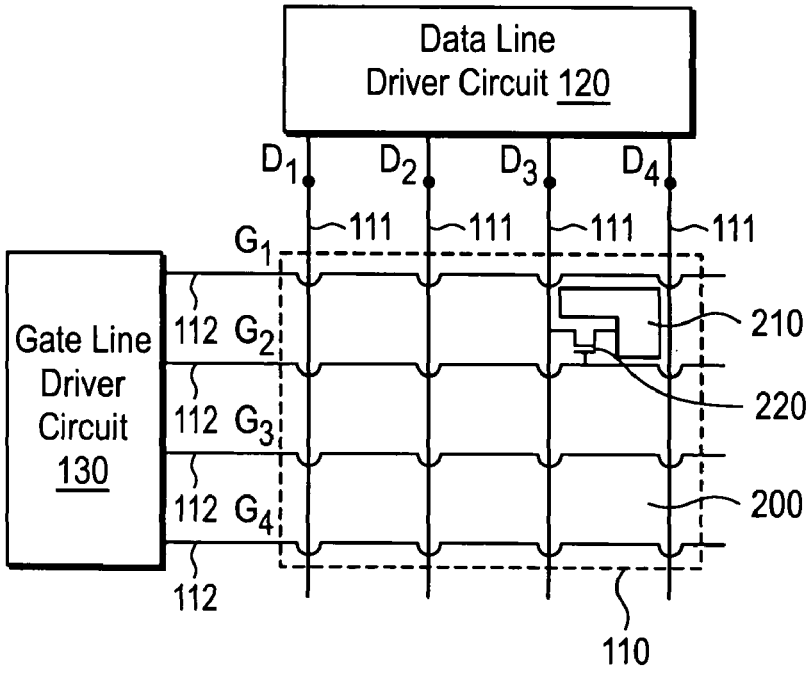
FIG. 2 (Prior Art)
FIG. 2 is a circuit diagram illustrating an exemplary prior art active matrix array within the display system.

FIG. 2 is a circuit diagram illustrating an exemplary active matrix array 110 within the display system 100. As illustrated in FIG. 2, the active matrix array 110 includes a plurality of pixels 200 arranged in a matrix form, each pixel 200 further including a pixel electrode 210 coupled to a switching element 220, such as, for example, a thin film transistor (TFT) device. The data line driver circuit 120 supplies video signals through multiple data lines, of which data lines $D_1$-$D_4$ 111 are shown, each data line 111 extending longitudinally from the data line driver circuit 120 to corresponding TFT devices 220. The gate line driver circuit 130 supplies timing signals at predetermined intervals through multiple gate lines, of which gate lines $G_1$-$G_4$ 112 are shown, each gate line 112 extending horizontally from the gate line driver circuit 130 to corresponding TFT devices 220.

The data line driver circuit 120 supplies the video signals as voltages to the TFT devices 220, which are turned on and off using the timing signals applied in sequence from the gate line driver circuit 130. Specifically, each TFT device 220 keeps the corresponding pixel electrode 210 at a predetermined voltage, based on the video signal supplied to the pixel electrode 210 in response to a timing signal, until it receives a subsequent timing signal from the gate line driver circuit 130.

In amorphous or polycrystalline silicon technology, the gate line driver circuit 130 includes a shift register and/or a pass-transistor based demultiplexer module, as described in detail, for example, in "Stability Issues In Digital Circuits In Amorphous Silicon Technology," by N. Mohan et al., Proc. IEEE CCECE 2001, Toronto, Canada, May 13-16, 2001, and in "Amorphous Silicon Shift Registers For Display Drivers," by A. Kumar et al., J. Vac. Sci. Technol. A 22.3, May/June 2004. The shift register within the gate line driver circuit 130 further includes multiple concatenated shift register cells, each shift register cell being assigned to one gate line 112 in the active matrix array 110.

Figure 3:
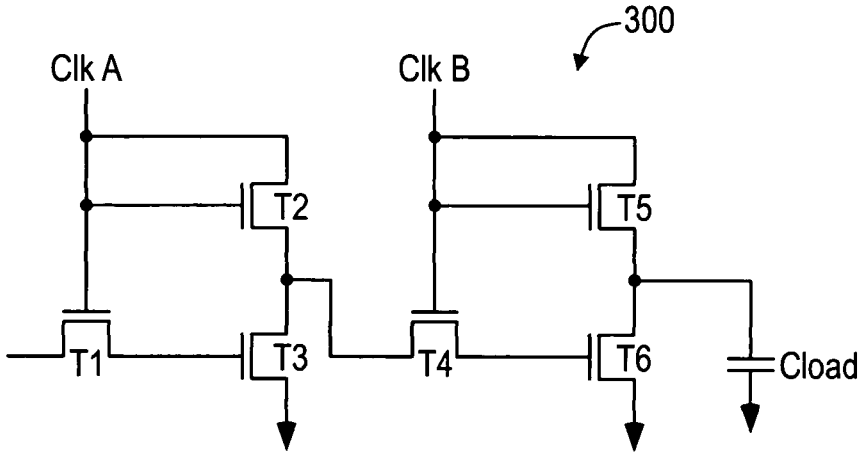
FIG. 3 (Prior Art)
FIG. 3 is a circuit diagram illustrating an exemplary prior art shift register cell within the display system.
Figure 4:
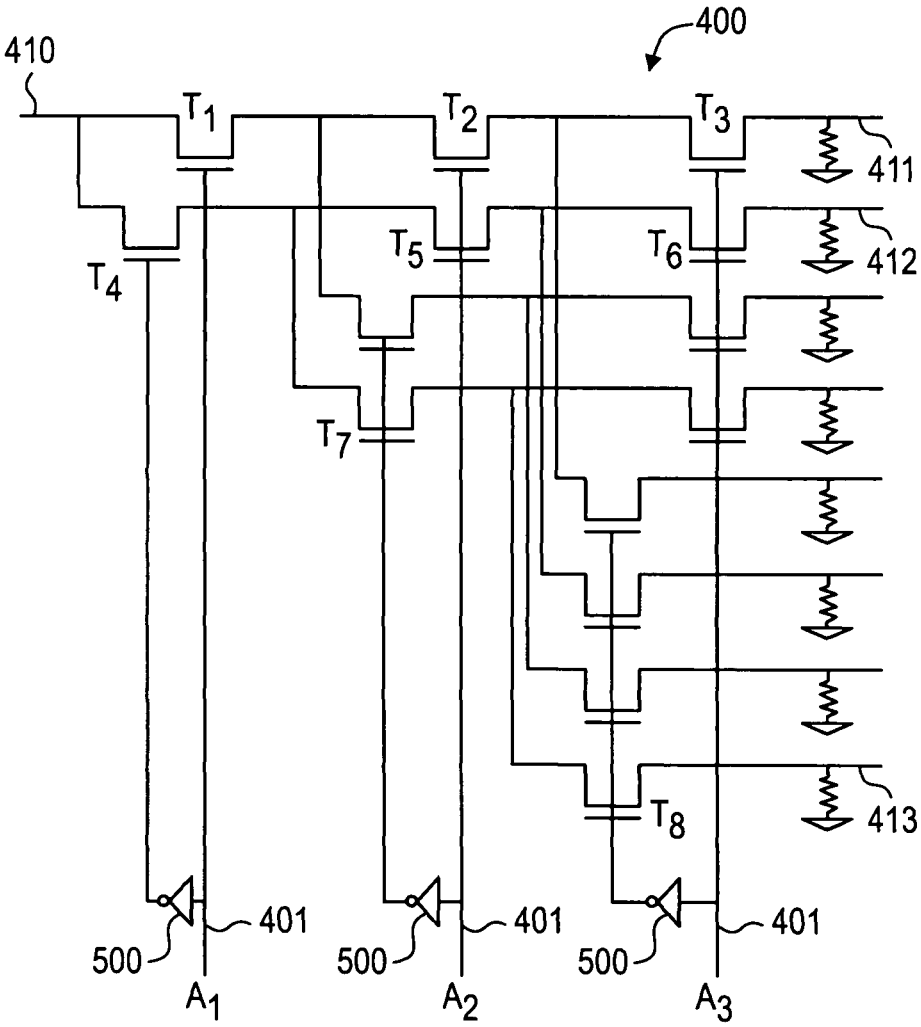
FIG. 4 (Prior Art)
FIG. 4 is a circuit diagram illustrating an exemplary prior art 1-8 demultiplexer module within the display system.
Figure 5:
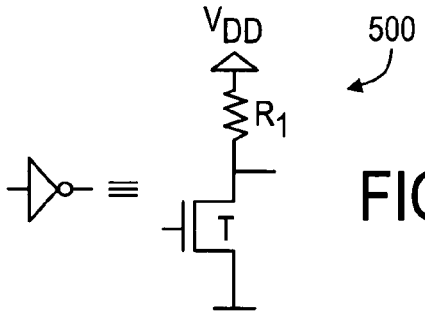
FIG. 5 (Prior Art)
FIG. 5 is a circuit diagram illustrating an exemplary prior art inverter circuit within the 1-8 demultiplexer module.

FIG. 3 is a circuit diagram illustrating an exemplary shift register cell 300 within the gate line driver circuit 130. As a pulse is shifted through concatenated shift register cells 300 by a two-phase clock emitting clock signals CLK A and CLK B, the parallel output of each cell 300 asserts its corresponding gate line 112 in sequence. Shift registers only require one level of decoding, but do not allow the addressing of an arbitrary gate line, as may be required in a sensing application, for example. FIGS. 4, 5 illustrate an exemplary three-stage 1-8 demultiplexer module 400 within the gate line driver circuit 130 and an exemplary inverter circuit 500 within the 1-8 demultiplexer module 400, respectively. Binary demultiplexer modules, such as the one shown in FIGS. 4, 5, provide for arbitrary selection of gate lines 112, but are limited in the number of cascaded stages due to the low mobility of the amorphous silicon. Specifically, the amorphous silicon introduces a propagation delay at each of the cascaded stages of tens of microseconds and, thus, for a large number of stages, the delay becomes sizeable and affects the overall performance of the circuit.

As shown in FIG. 4, if a high voltage is asserted at all address lines 401, then transistor devices $T_1$, $T_2$, and $T_3$, corresponding to respective address lines 401, for example, $A_1$, $A_2$, $A_3$, are turned on and, due to an inverter circuit 500 coupled to each address line 401, transistor device $T_4$ is further turned off. Thus, a voltage applied at input 410 will travel to the corresponding selected output gate line 411. If a low voltage is asserted at address line $A_1$, for example, and a high voltage is maintained at address lines $A_2$ and $A_3$, then transistor device $T_1$ will be off and transistor devices $T_2$, $T_3$, $T_4$, $T_5$, and $T_6$ will be turned on. Thus, the voltage at the input 410 will travel through transistor devices $T_4$, $T_5$, and $T_6$ to the selected output gate line 412. If a low voltage is asserted at all address lines 401, for example, then transistor devices $T_1$, $T_2$, and $T_3$, corresponding to respective address lines $A_1$, $A_2$, $A_3$, are turned off and, due to the inverter circuit 500 coupled to each address line 401, transistor device $T_4$ is further turned on. Similarly, transistor devices $T_7$ and $T_8$ will be turned on, and the voltage at the input 410 will travel through transistor devices $T_4$, $T_7$, $T_8$ to the selected output gate line 413.

The embodiments described in detail below provide for arbitrary selection of a gate line 112 with a single level of decoding, with ability to compensate for threshold shift by reversing the gate bias, and with ability to provide for fault tolerance with an increased number of addressing lines.

Figure 6:
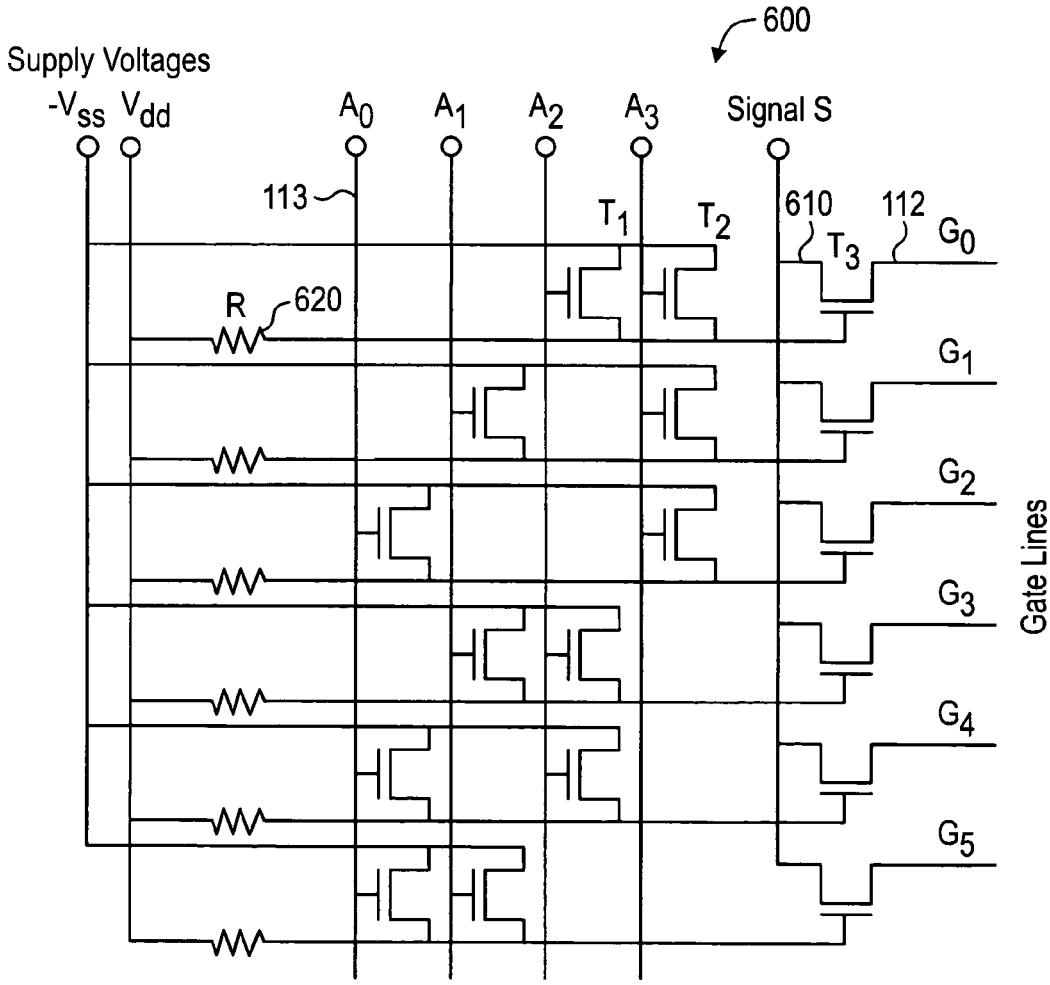
FIG. 6 is a block diagram illustrating an integrated line selection apparatus within active matrix arrays, according to one embodiment of the invention.

FIG. 6 is a block diagram illustrating an integrated line selection apparatus within active matrix arrays, according to one embodiment of the invention. As illustrated in FIG. 6, in one embodiment, the apparatus 600 is a gate line driver circuit similar to the gate line driver circuit 130 shown in FIG. 1. The apparatus 600 is coupled to multiple gate lines 112, such as, for example, gate lines $G_0$ through $G_5$. Each gate line 112 is coupled to one or more address lines 113, such as, for example, address lines $A_0$ through $A_3$ through multiple transistor devices.

In one embodiment, gate line $G_0$ is coupled to address lines $A_2$ and $A_3$ through transistor devices $T_1$, $T_2$, and $T_3$, such that the gate of transistor $T_3$ is coupled to the respective drains of transistors $T_1$ and $T_2$. The source of transistor $T_3$ receives an input signal S transmitted from a signal source (not shown), as described in detail below. If a high voltage is applied at either of the address lines $A_2$ or $A_3$, the corresponding transistor devices $T_1$ or $T_2$ will be turned on, thus causing a negative voltage at the gate of transistor $T_3$. As a result, the input signal S will not travel to the gate line $G_0$ and, thus, the gate line $G_0$ will be deselected. Similarly, all gate lines 112 that are coupled to either address lines $A_2$ or $A_3$, such as, for example, gate lines $G_1$ through $G_4$, will also be deselected. Therefore, the apparatus 600 enables selection of a single gate line 112, in this case gate line $G_5$, and the de-selection of the other remaining gate lines.

In one embodiment, the most gate lines 112 that can be addressed by m address lines 113 is $n=2^m(2/m\pi)^{1/2}$. Thus, if the number "m" of address lines 113 varies between 10 and 50, for example, the combinatorial addressing scheme will require approximately three additional address lines 113 in a single stage, as opposed to the binary addressing scheme. However, in a typical implementation, the binary addressing scheme for 1000 addressable gate lines 112 usually requires ten stages, which would create prohibiting delays in amorphous silicon technology.

Referring back to FIG. 6, the gate of each gate line drive transistor device 610 is further coupled to a resistor device 620. Specifically, in one embodiment, the gate of transistor $T_3$ is coupled to a resistor device 620 having a resistance parameter R. In this embodiment, the resistance R of each resistor device 620 is smaller than the off-state source-drain resistance $R_{off}$ of all of the connected address transistor devices in parallel by a predetermined factor, such that, for example, R is at least 100 times smaller than $R_{off}$. The resistance is also larger than the resistance $R_{on}$ of a single transistor device in an ON state by a factor of 100. Then $R=2R_{off}/100m$, where "m" is the number of address lines 113, and $R=100R_{on}$. Eliminating the value of the pull-up resistor gives $R_{off}/R_{on}=10^4m/2$. Therefore, for 1000 addressable gate lines 112, it is necessary for the on-off ratio of the transistor devices to be on the order of $10^5$, a result easily achieved with amorphous silicon technology, wherein, typically, amorphous silicon transistors exhibit on/off ratios of $10^6$.

Figure 7:
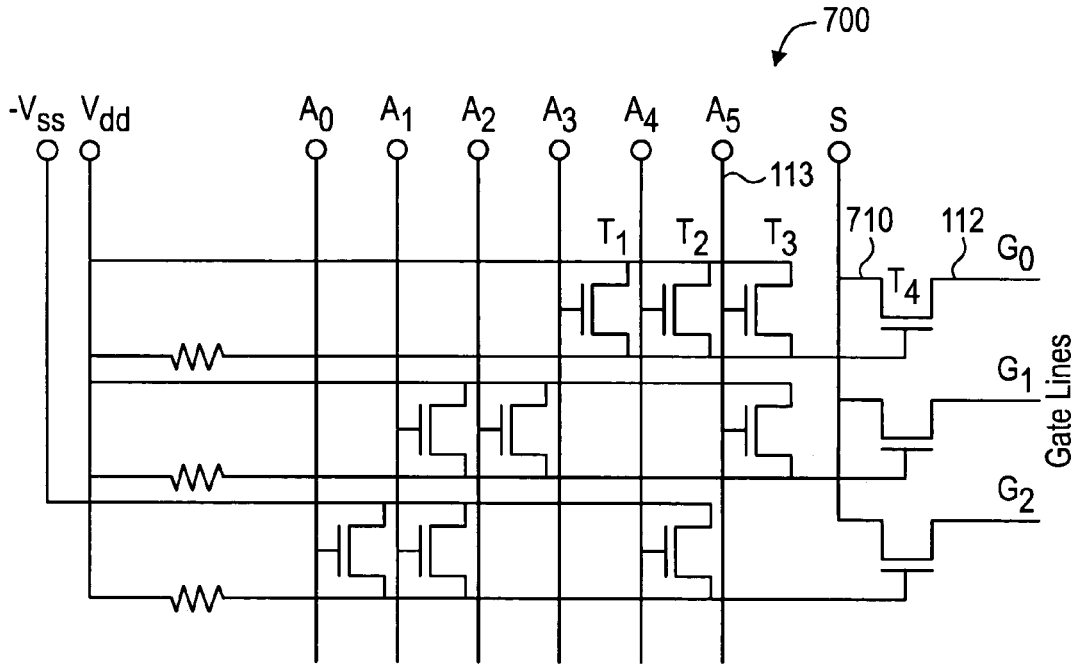
FIG. 7 is a circuit diagram illustrating an integrated line selection apparatus within active matrix arrays, according to an alternate embodiment of the invention.

FIG. 7 is a circuit diagram illustrating a fault tolerant apparatus for selecting lines within active matrix arrays, according to an alternate embodiment of the invention. As illustrated in FIG. 7, the apparatus 700 is coupled to multiple gate lines 112, such as, for example, gate lines $G_0$ through $G_2$. Each gate line 112 is coupled to one or more address lines 113, such as, for example, address lines $A_0$ through $A_5$ through multiple transistor devices.

In one exemplary embodiment, gate line $G_0$ is coupled to address lines $A_3$, $A_4$, and $A_5$ through transistor devices $T_1$, $T_2$, $T_3$, and $T_4$ such that the gate of transistor $T_4$ is coupled to the respective drains of transistors $T_1$, $T_2$, and $T_3$. The source of transistor $T_4$ receives an input signal S transmitted from a signal source (not shown), as described in detail below. Similarly, gate line $G_1$ is coupled to address lines $A_1$, $A_2$, and $A_5$, and gate line $G_2$ is coupled to address lines $A_0$, $A_1$, and $A_4$.

In the embodiment shown in FIG. 7, which performs similarly to the embodiment described in connection with FIG. 6, fault tolerance is provided through an increase in the number of address lines 113. Fault-tolerant addressing systems are further described in U.S. Pat. No. 6,535,455, which is incorporated by reference in its entirety herein.

Assuming that each bit of the gate line address is defined as having a "0" value if there is no connection between the address line 113 and the gate of the corresponding gate line transistor device 710, and, otherwise, each bit is defined as having a "1" value, then the 4-bit address of the gate line $G_0$ in the embodiment of FIG. 6 is 1100 ($A_3$-$A_0$). Each address of a particular gate line 112 differs from the gate line address corresponding to any other gate line 112 by the position of a single "1" value. Referring now to FIG. 7, due to the increase in the number of address lines 113, each address of a particular gate line 112 differs from the gate line address corresponding to any other gate line 112 by the position of two "1" values. Thus, even if a single address line 113 were to be removed from the address of all gate lines 112, the addresses would still be unique. As a result, if an address line 113 were to become open at any time during the operation of the circuit embodied in the apparatus 700, all of the gate lines 112 would still be correctly addressed. Alternatively, any one transistor device on each select gate line 112 could become open and the circuit would also operate correctly.

The effects of threshold voltage shifts in the embodiments of FIGS. 6, 7 are ameliorated by reversing the gate-source voltage stress during the off time of the transistor devices. The gate line drive transistor devices 610, 710 have a low duty cycle and can have the gate source stress reversed by appropriate selection of a predetermined level for the negative voltage $-V_{SS}$.

Figure 8:
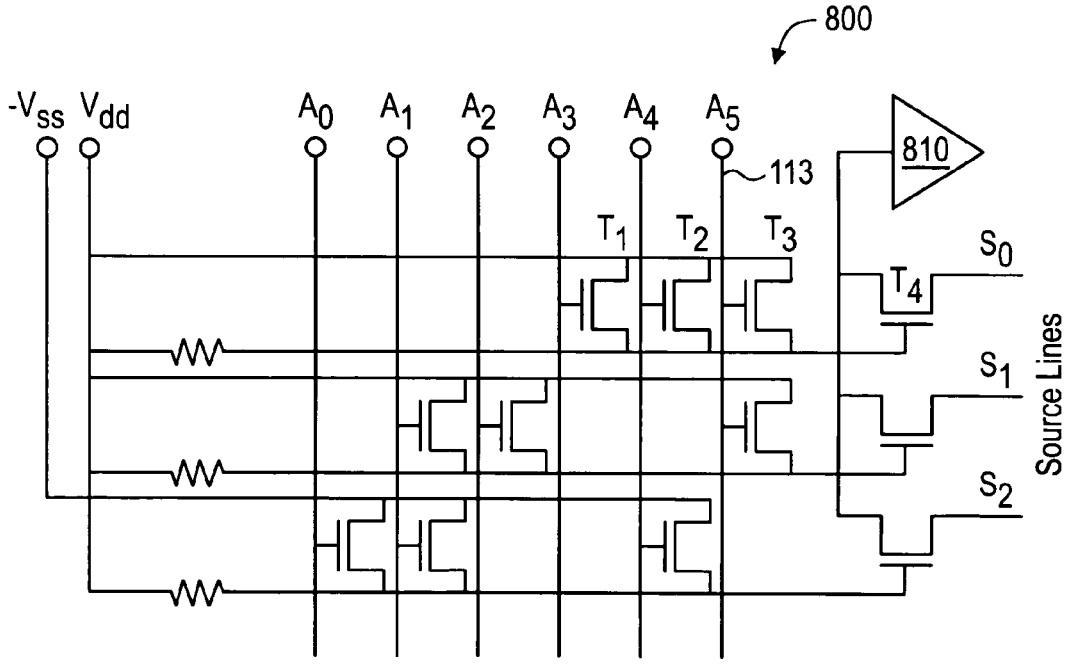
FIG. 8 is a circuit diagram illustrating an integrated line selection apparatus within active matrix arrays, according to another alternate embodiment of the invention.

FIG. 8 is a circuit diagram illustrating an integrated line selection apparatus within active matrix arrays, according to another alternate embodiment of the invention. As illustrated in FIG. 8, the apparatus 800 operates as a multiplexer module and receives signals from an array of sensors (not shown) through multiple source lines, such as, for example, source lines $S_0$ through $S_2$. The source lines $S_0$ through $S_2$ are coupled to a current or voltage amplifier module 810 through a circuit similar to the circuit shown and described above in connection with FIG. 7.

Figure 9:
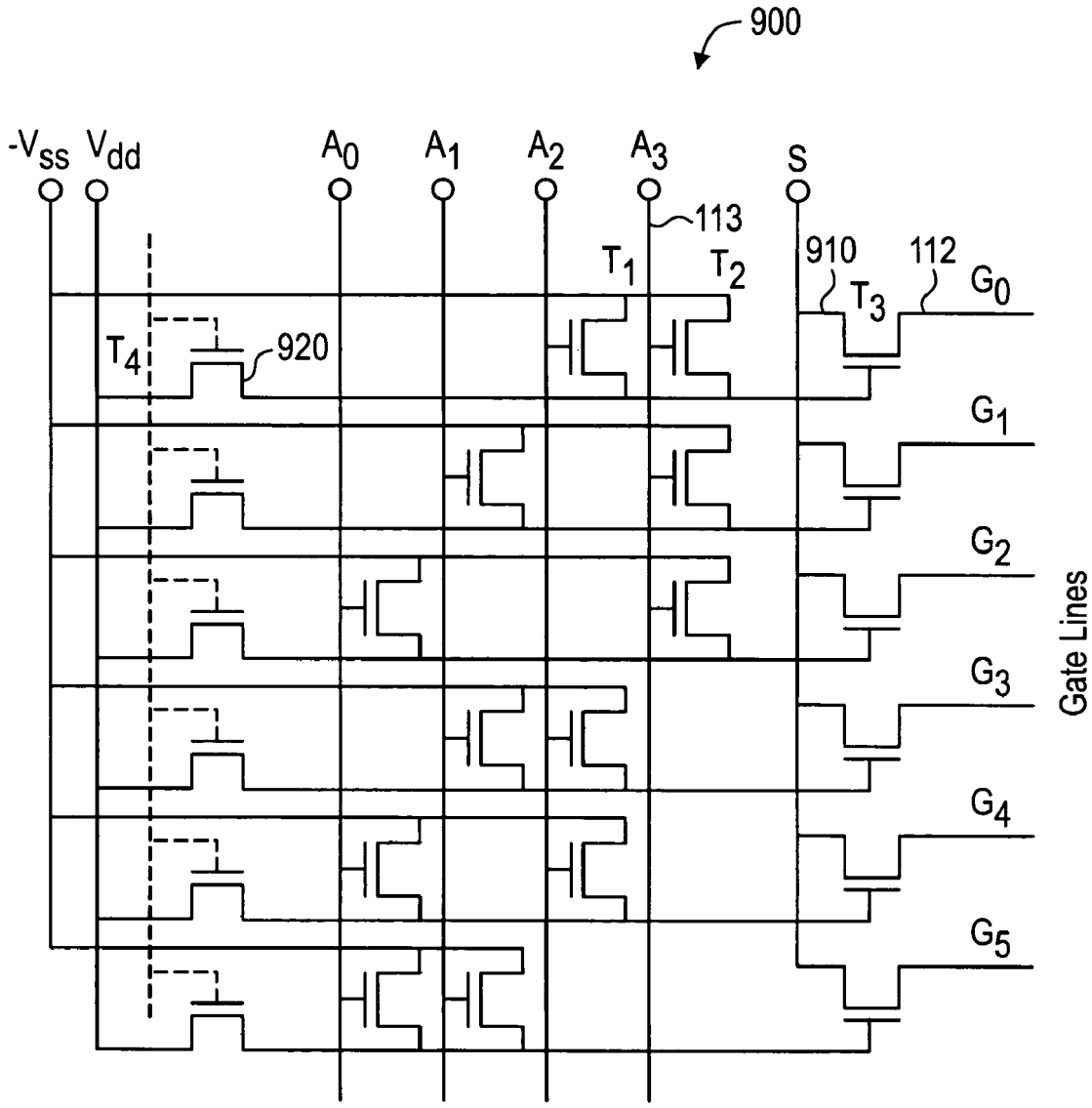
FIG. 9 is a circuit diagram illustrating an integrated line selection apparatus within active matrix arrays, according to another alternate embodiment of the invention.

FIG. 9 is a circuit diagram illustrating an integrated line selection apparatus within active matrix arrays, according to another alternate embodiment of the invention. As illustrated in FIG. 9, the apparatus 900 is coupled to multiple gate lines 112, such as, for example, gate lines $G_0$ through $G_5$. Each gate line 112 is coupled to one or more address lines 113, such as, for example, address lines $A_0$ through $A_3$ through multiple transistor devices.

In one exemplary embodiment, gate line $G_0$ is coupled to address lines $A_2$ and $A_3$ through transistor devices $T_1$, $T_2$, and $T_3$, such that the gate of transistor $T_3$ is coupled to the respective drains of transistors $T_1$ and $T_2$. The source of transistor $T_3$ receives an input signal S transmitted from a signal source (not shown), as described in detail below. The gate of each transistor device 910 is further coupled to a pull-up transistor device 920. Specifically, in one example, transistor $T_3$ is further coupled to transistor $T_4$. The use of pull-up transistor $T_4$ in the embodiment shown in FIG. 9 enables a reduction in the complexity of the manufacturing process because the transistor replacing the load resistor can be fabricated using the same process as the switching transistors and allows for compensation for threshold shifts in the circuit.

Figure 10:
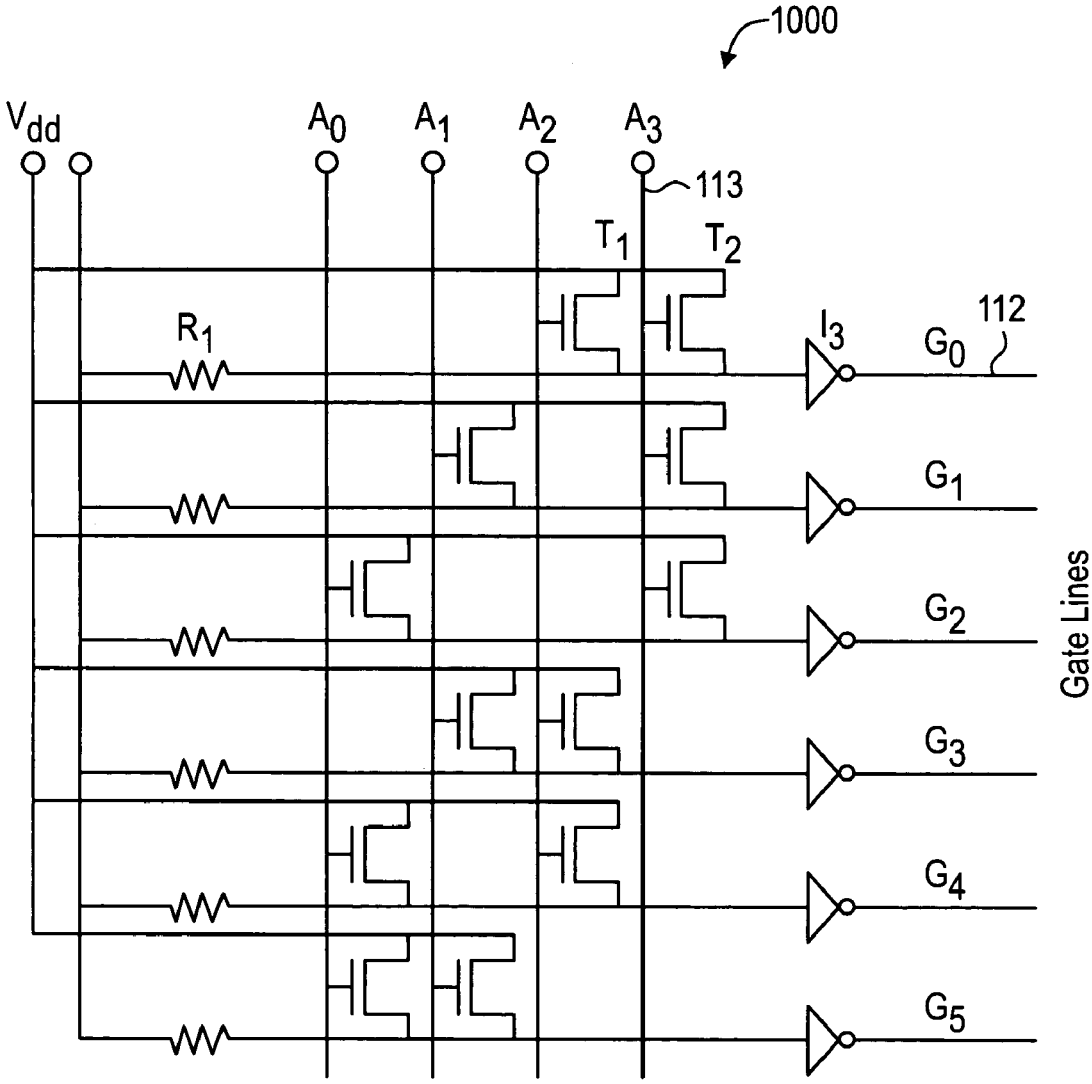
FIG. 10 is a circuit diagram illustrating an integrated line selection apparatus within active matrix arrays, according to another alternate embodiment of the invention.

FIG. 10 is a circuit diagram illustrating an integrated line selection apparatus within active matrix arrays, according to another alternate embodiment of the invention. As illustrated in FIG. 10, the apparatus 1000 is coupled to multiple gate lines 112, such as, for example, gate lines $G_0$ through $G_5$. Each gate line 112 is coupled to one or more address lines 113, such as, for example, address lines $A_0$ through $A_3$ through multiple transistor devices.

In one embodiment, gate line $G_0$ is coupled to address lines $A_2$ and $A_3$ through transistor devices $T_1$, $T_2$, and inverter device $I_3$, such that the input of the inverter device $I_3$ is coupled to the respective drains of transistors $T_1$ and $T_2$. If a high voltage is applied at either of the address lines $A_2$ or $A_3$, the corresponding transistor devices $T_1$ or $T_2$ will be turned on, thus causing the voltage $V_{dd}$ to be applied to the input of the inverter device $I_3$. As a result, the gate line $G_0$ will be deselected. Similarly, all gate lines 112 that are coupled to either address lines $A_2$ or $A_3$, such as, for example, gate lines $G_1$ through $G_4$, will also be deselected. Therefore, the apparatus 1000 enables selection of a single gate line 112, in this case gate line $G_5$, and the de-selection of all the other remaining gate lines.

In another example, a circuit for selecting lines within an active matrix array includes a plurality of gate line drive transistor devices, each gate line drive transistor device having a drain coupled to a respective gate line of a plurality of gate lines within said active matrix array and a source to receive an input signal. The circuit also includes at least one address line transistor device corresponding to said each gate line drive transistor device, each address line transistor device having a drain coupled to a gate of said corresponding gate line drive transistor device and a gate coupled to a corresponding address line of a plurality of address lines within said active matrix array. By asserting a predetermined combination of voltages on said plurality of address lines, a single gate line of said plurality of gate lines is selected to receive said input signal to be transmitted to a corresponding pixel within said active matrix array. Furthermore, the circuit includes a plurality of inverter devices, each inverter device coupled to said respective gate line of said plurality of gate lines to receive said input signal when said single gate line is selected.

Figure 11:
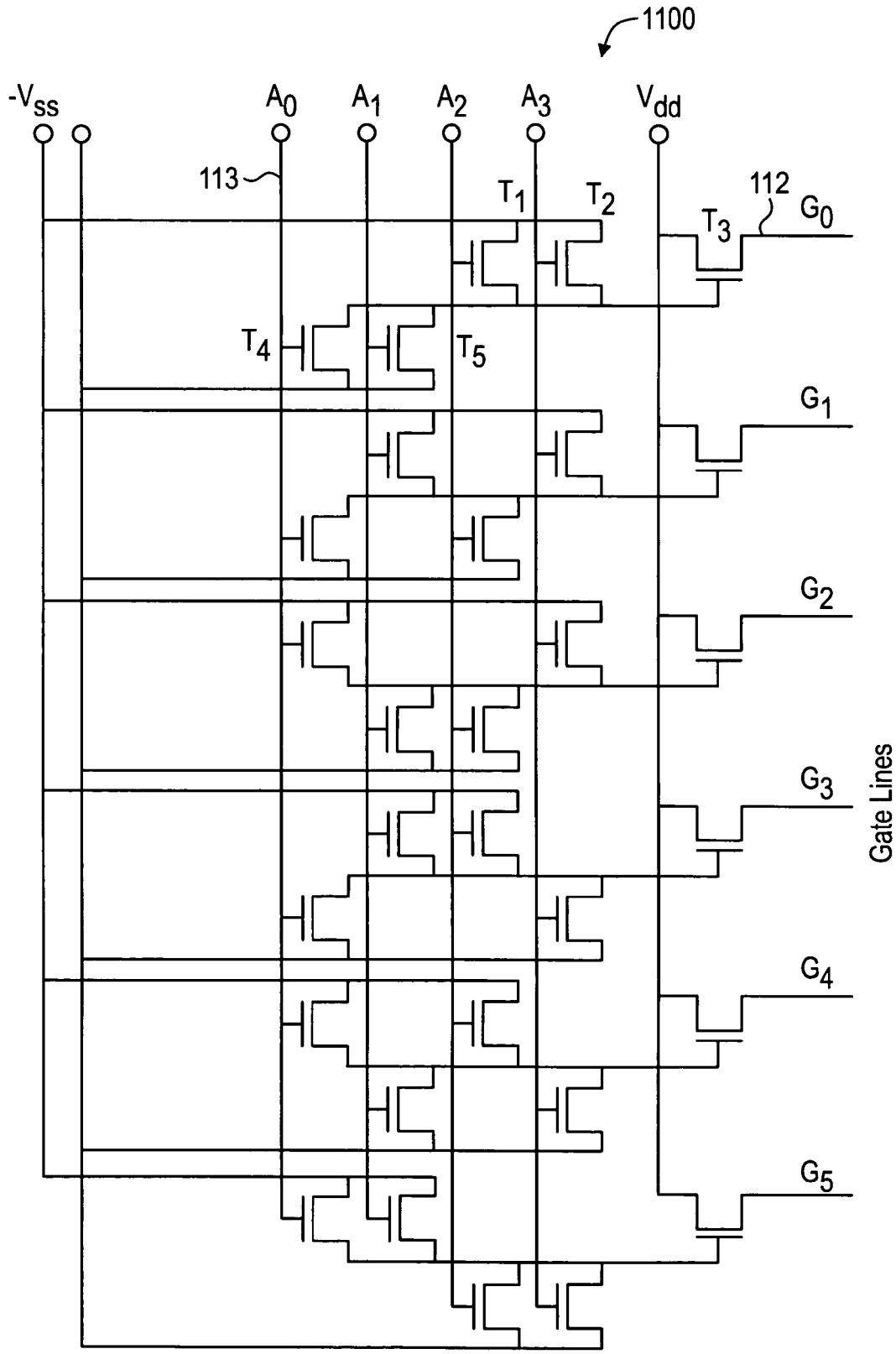
FIG. 11 is a circuit diagram illustrating an integrated line selection apparatus within active matrix arrays, according to another alternate embodiment of the invention.

FIG. 11 is a circuit diagram illustrating an integrated line selection apparatus within active matrix arrays, according to another alternate embodiment of the invention. As illustrated in FIG. 11, the apparatus 1100 is coupled to multiple gate lines 112, such as, for example, gate lines $G_0$ through $G_5$. Each gate line 112 is coupled to one or more address lines 113, such as, for example, address lines $A_0$ through $A_3$ through multiple transistor devices.

In one embodiment, gate line $G_0$ is coupled to address lines $A_2$ and $A_3$ through transistor devices $T_1$, $T_2$, $T_3$ and is coupled to address lines $A_0$ and $A_1$ through transistor devices $T_3$, $T_4$, $T_5$, such that the gate of transistor $T_3$ is coupled to the respective drains of transistors $T_1$ and $T_2$ and to the sources of transistors $T_4$ and $T_5$. The source of transistor $T_3$ is coupled to a voltage source $V_{dd}$ or more generally a signal source 410. If a high voltage is applied at either of the address lines $A_0$ or $A_1$, the corresponding transistor devices $T_4$ or $T_5$ will be turned on, thus causing a voltage $V_{dd}$ to be applied at the gate of transistor $T_3$. As a result, the voltage $V_{dd}$ will turn on the transistor $T_3$ and the signal 410 transferred to the gate line $G_0$ will if none of the transistor devices connected to $-V_{ss}$, such as, for example, transistors $T_1$ or $T_2$, are turned on. Alternatively, if a high voltage is applied at either of the address lines $A_2$ or $A_3$, the corresponding transistor devices $T_1$ or $T_2$ coupled to $-V_{ss}$ will be turned on, and a negative voltage $-V_{ss}$ will be applied at the gate of the transistor $T_3$. Thus, in this embodiment, the bias on the select transistor device $T_3$ can be made positive or negative based on the voltage selection applied at each address line 113 to counter any long term threshold drift.

Figure 12:
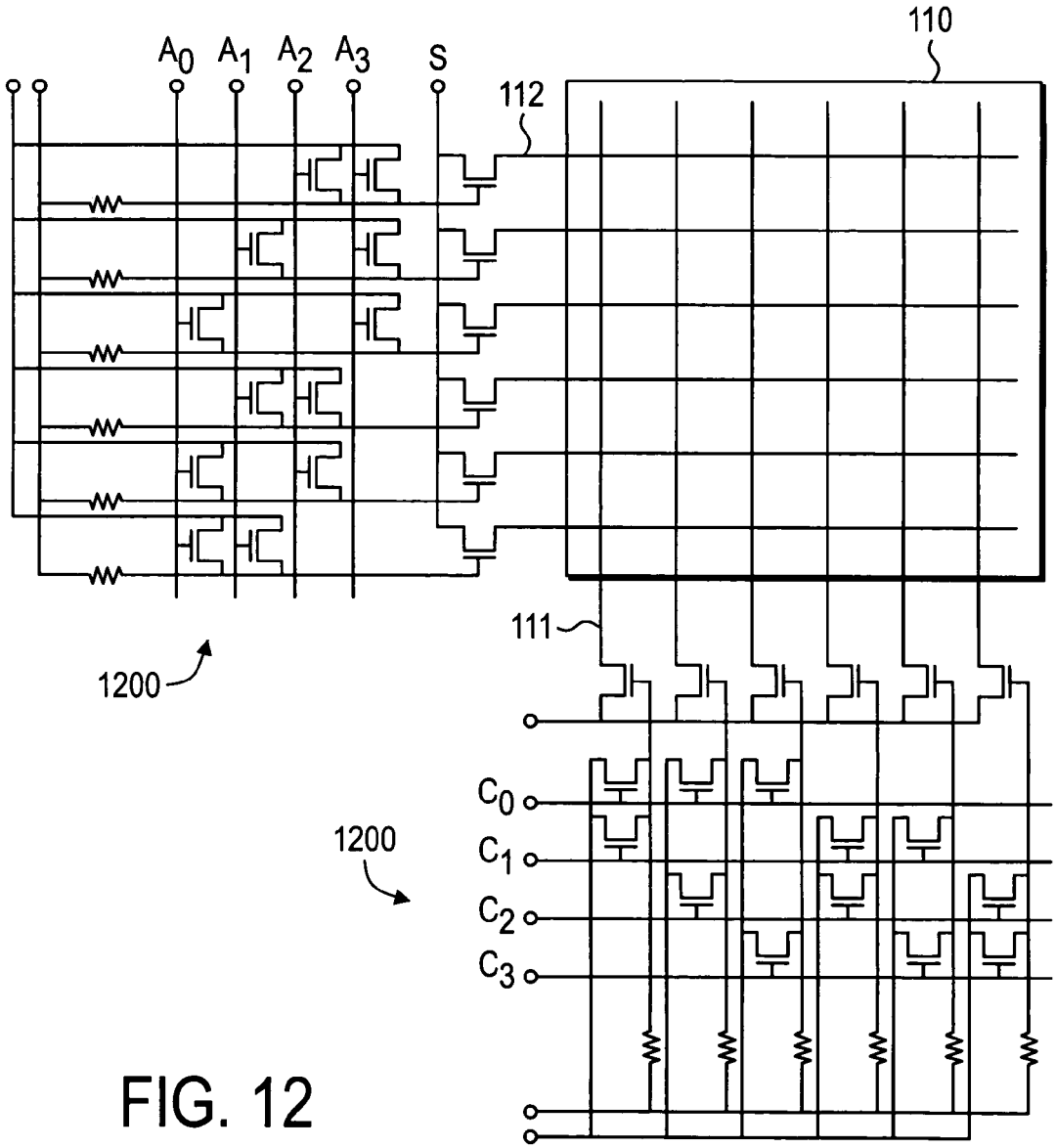
FIG. 12 is a block diagram illustrating an integrated line selection apparatus within active matrix arrays, according to another alternate embodiment of the invention.

FIG. 12 is a block diagram illustrating an integrated line selection apparatus within active matrix arrays, according to another alternate embodiment of the invention. As illustrated in FIG. 12, the apparatus 1200 is used to demultiplex both the gate lines 112 and the data lines 111 of the active matrix array 110. Thus, the number of interconnects are minimized at the expense of reduced data throughput since only one element of the active matrix array 110 can be addressed at any given time. However, the throughput can be increased by subdividing the data lines 111 into groups, such that multiple data lines 111 may be selected simultaneously, but still with a fraction of the number of interconnects required, for example, if all the data lines 111 are asserted in parallel.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The various illustrative logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such the processor may read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A circuit for selecting lines within an active matrix array, the circuit comprising:

a plurality of gate line drive transistor devices, each gate line drive transistor device having a drain coupled to a respective gate line of a plurality of gate lines within said active matrix array and a source to receive an input signal;

at least one address line transistor device corresponding to said each gate line drive transistor device, each address line transistor device having a drain coupled to a gate of said corresponding gate line drive transistor device and a gate coupled to a corresponding address line of a plurality of address lines within said active matrix array, such that by asserting a predetermined combination of voltages on said plurality of address lines, a single gate line of said plurality of gate lines is selected to receive said input signal to be transmitted to a corresponding pixel within said active matrix array; and a plurality of resistor devices, each resistor device being coupled to said drain of said at least one address line transistor device and to said gate of said corresponding gate line drive transistor device, wherein a resistance value of said each resistor device is at least one of: (1) smaller than an off-state source-drain resistance of said at least one corresponding address line transistor device by a predetermined factor, or (2) larger than an on-state resistance of said at least one corresponding address line transistor device.

2. The circuit according to claim 1, wherein said predetermined factor is 100.

3. The circuit according to claim 1, wherein each gate line of said plurality of gate lines corresponds to a unique address if an address line of said plurality of address lines is subsequently removed.

4. The circuit according to claim 1, wherein each gate line of said plurality of gate lines corresponds to a unique address if an address line transistor device of said at least one address line transistor device is subsequently opened.

5. The circuit according to claim 1, further comprising a plurality of inverter devices, each inverter device coupled to said respective gate line of said plurality of gate lines to receive said input signal when said single gate line is selected.

6. The circuit according to claim 1, wherein by asserting a high voltage on at least one address line of said plurality of address lines, a single gate line of said plurality of gate lines is deselected to receive said input signal to be transmitted to said corresponding pixel within said active matrix array.

7. A method to select lines within an active matrix array, the method comprising:

asserting a predetermined combination of voltages on a plurality of address lines coupled to a plurality of gate lines within said active matrix array;

selecting a single gate line of said plurality of gate lines to receive an input signal to be transmitted to a corresponding pixel within said active matrix array;

coupling a drain of each gate line drive transistor device of a plurality of gate line drive transistor devices to a respective gate line of said plurality of gate lines, each gate line drive transistor device having a source to receive said input signal;

coupling a drain of at least one address line transistor device corresponding to said each gate line drive transistor device to a gate of said corresponding gate line drive transistor device and a gate of said at least one address line transistor device to a corresponding address line of said plurality of address lines; and coupling each resistor device of a plurality of resistor devices to said drain of said at least one address line transistor device and to said gate of said corresponding gate line drive transistor device, wherein a resistance value of said each resistor device is at least one of: (1) smaller than an off-state source-drain resistance of said at least one corresponding address line transistor device by a predetermined factor, or (2) larger than an on-state resistance of said at least one corresponding address line transistor device.

8. The method according to claim 7, wherein said predetermined factor is 100.

9. The method according to claim 7, wherein each gate line of said plurality of gate lines corresponds to a unique address if an address line of said plurality of address lines is subsequently removed.

10. The method according to claim 7, wherein each gate line of said plurality of gate lines corresponds to a unique address if an address line transistor device of said at least one address line transistor device is subsequently opened.

11. The method according to claim 7, further comprising coupling each inverter device of a plurality of inverter devices to said respective gate line of said plurality of gate lines to receive said input signal when said single gate line is selected.

12. The method according to claim 7, wherein said asserting further comprises:

asserting a high voltage on at least one address line of said plurality of address lines, such that a single gate line of said plurality of gate lines is deselected to receive said input signal to be transmitted to said corresponding pixel within said active matrix array.

13. A circuit for selecting lines within an active matrix array, the circuit comprising:

a plurality of gate line drive transistor devices, each gate line drive transistor device having a drain coupled to a respective gate line of a plurality of gate lines within the active matrix array;

at least one first address line transistor device corresponding to said each gate line drive transistor device, each first address line transistor device having a drain coupled to a gate of said corresponding gate line drive transistor device and a gate coupled to a first corresponding address line of a plurality of address lines; and at least one second address line transistor device corresponding to said each gate line drive transistor device, each second address line transistor device having a source coupled to a gate of said corresponding gate line drive transistor device and a gate coupled to a second corresponding address line of the plurality of address lines, a single gate line of said plurality of gate lines is to be selected to receive an input signal to be transmitted to a corresponding pixel within said active matrix array when a combination of high and low voltages is asserted on said plurality of address lines.

* * * * *